United States Patent [19]

Besemann

[11] Patent Number: 4,708,332

[45] Date of Patent: Nov. 24, 1987

[54] METHOD AND APPARATUS FOR ZIG-ZAG FOLDING WEBS OF PAPER AND THE LIKE

[75] Inventor: Alfred Besemann, Hamburg, Fed. Rep. of Germany

[73] Assignee: E.C.H. Will (GmbH & Co.), Hamburg, Fed. Rep. of Germany

[21] Appl. No.: 881,193

[22] Filed: Jul. 2, 1986

[30] Foreign Application Priority Data

Jul. 6, 1985 [DE] Fed. Rep. of Germany ..... 3424246

[51] Int. Cl.[4] ..... B41L 1/32

[52] U.S. Cl. ..... 270/39; 493/418; 493/450; 198/462

[58] Field of Search ..... 270/39; 83/513, 519, 83/563, 564; 493/408, 410, 416, 418, 450, 358; 198/461–462

[56] References Cited

U.S. PATENT DOCUMENTS

| | | | |
|---|---|---|---|
| 3,086,768 | 4/1963 | Lach | 270/39 X |
| 3,429,568 | 2/1969 | Alford, Jr. | 493/418 |
| 3,490,762 | 1/1970 | Nystrand | 270/39 X |
| 3,544,099 | 12/1970 | Cooke et al. | 493/418 |
| 3,656,741 | 4/1972 | Macke et al. | 493/418 |
| 3,784,188 | 1/1974 | Deligt | 83/512 |
| 3,858,476 | 1/1975 | Deligt | 83/512 |
| 4,082,259 | 4/1978 | Anderson | 493/450 X |
| 4,102,531 | 7/1978 | Jiminez | 493/418 X |

FOREIGN PATENT DOCUMENTS 2264633 7/1974 Fed. Rep. of Germany .

*Primary Examiner*—E. H. Eickholt
*Attorney, Agent, or Firm*—Peter K. Kontler

[57] ABSTRACT

A continuous web of paper with a series of transversely extending rows of perforations between successive panels is folded in zig-zag fashion by reducing the speed of each oddly numbered panel and simultaneously diverting the oddly numbered panel from the path of the web while the evenly numbered panels immediately following the diverted oddly numbered panels continue to advance at a higher speed so that the neighboring panels define loops while the next-following evenly numbered panels catch up with the immediately preceding oddly numbered panels. The loops are stabilized by suction-operated conveyors and by admission of compressed air thereinto, and the resulting stack of overlapping panels is severed at intervals across selected rows of perforations to form a series of smaller stacks each of which contains a desired number of panels.

20 Claims, 1 Drawing Figure

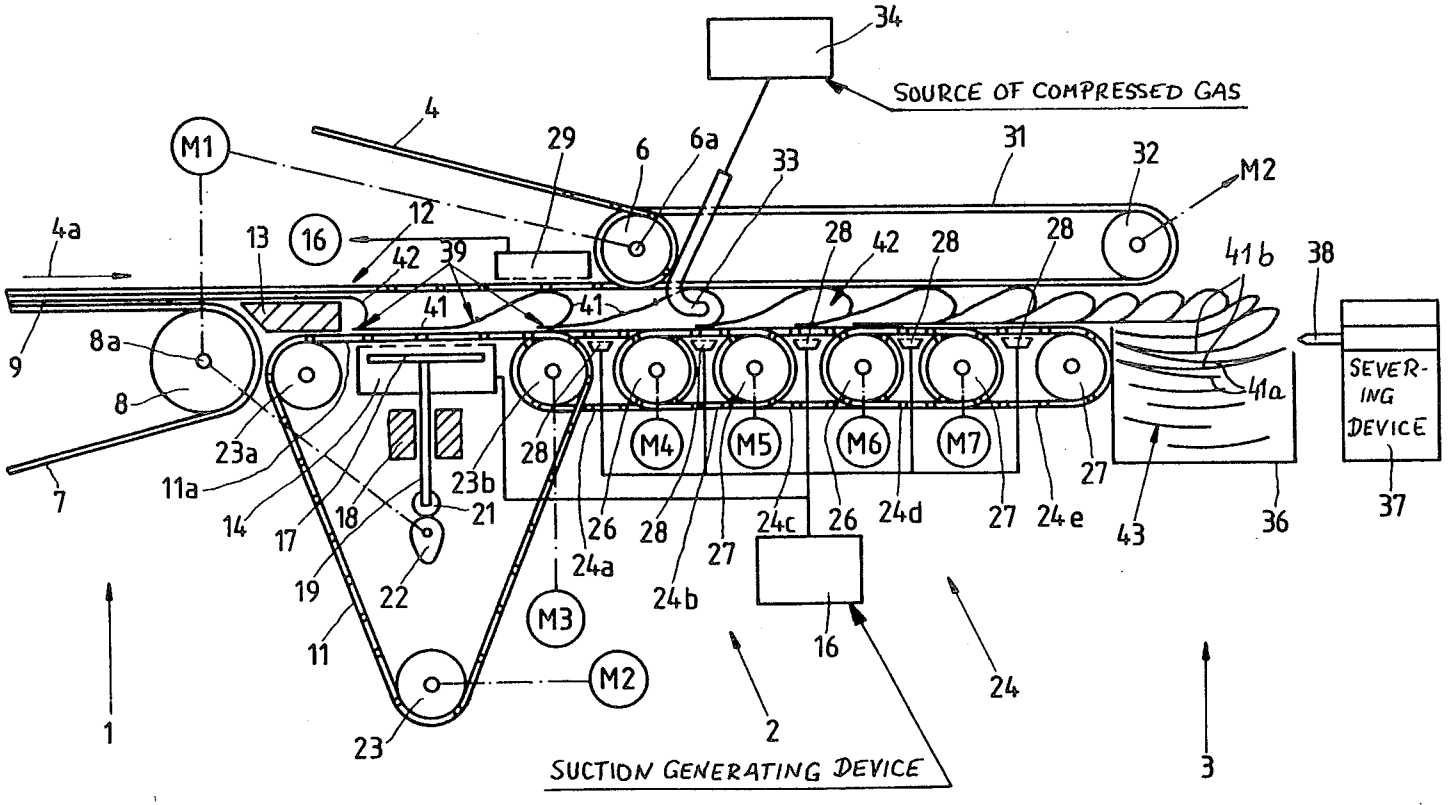
SEVER-
ING
DEVICE
SOURCE OF COMPRESSED GAS
SUCTION GENERATING DEVICE
M1
M2
M3
M4
M5
M6
M7
16
1
2
3
4
4a
6
6a
7
8
8a
9
11
11a
12
13
14
17
18
19
21
22
23
23a
23b
24
24a
24b
24c
24d
24e
26
27
28
29
31
32
33
34
36
37
38
39
41
41a
41b
42
43

METHOD AND APPARATUS FOR ZIG-ZAG FOLDING WEBS OF PAPER AND THE LIKE

BACKGROUND OF THE INVENTION

The invention relates to methods and apparatus for manipulating webs of paper or the like, and more particularly to improvements in methods and apparatus for folding continuous webs of paper or the like (hereinafter called webs or paper webs). Still more particularly, the invention relates to improvements in methods and apparatus for zig-zag folding continuous paper webs of the type wherein successive sections or panels of the webs are connected to each other by weakened web portions, particularly by transversely extending lines of perforations, slits or the like.

The provision of equidistant or otherwise distributed transversely extending weakened portions (hereinafter called perforations or rows of perforations) in paper webs which are to be folded in zig-zag fashion is desirable in order to allow for predictable folding of the webs and for the formation of stacks which are easy to handle. In accordance with a known proposal, a paper web is fed vertically downwardly and is taken over by two endless belt conveyors which diverge to define a downwardly expanding triangular chamber and have grippers serving to engage the web in the regions of alternate rows of perforations to thus convert the web into a stack wherein the panels are piled up on top of each other in zig-zag fashion. Reference may be had to German Offenlegungsschrift No. 22 64 633.

OBJECTS AND SUMMARY OF THE INVENTION

An object of the invention is to provide a novel and improved method of zig-zag folding webs of paper or the like in a small area, with a high degree of predictability, and without undesirable creasing of the web.

Another object of the invention is to provide a method which can be practiced for the folding of wide, narrow, lightweight, relatively heavy, sensitive or sturdy webs with the same degree of facility and predictability.

A further object of the invention is to provide a method which renders it possible to ensure that successive panels of the web accurately overlap each other.

An additional object of the invention is to provide a method which can be utilized to form a succession of stacks of zig-zag folded panels each of which contains a predetermined number of stacked panels.

A further object of the invention is to provide a novel and improved apparatus for the practice of the above outlined method and to construct and assemble the apparatus in such a way that its space requirements (particularly its height) are a mere fraction of the space requirements of conventional zig-zag folding apparatus.

Still another object of the invention is to provide the apparatus with novel and improved means for converting a continuous web with transversely extending weakened zones into a series of discrete stacks of folded panels wherein each stack contains a predetermined number of panels.

A further object of the invention is to provide an apparatus which can reliably fold a wide variety of webs having different dimensions and/or other characteristics.

An additional object of the invention is to provide the apparatus with novel and improved means for diverting selected panels of the web from their path on the way toward a stacking station.

Another object of the invention is to provide the apparatus with novel and improved means for rapidly folding each oddly numbered panel of the web over or under the immediately preceding or following evenly numbered panel.

One feature of the present invention resides in the provision of a method of zig-zag folding a continuous web of paper or other flexible material which has alternating first and second panels connected to each other by transversely extending weakened zones in the form of rows of perforations or the like. The method comprises the steps of transporting the web at a first speed in a predetermined direction and along a first path, diverting at least a portion of each of successive first panels from the first path into a second path (such second path is or can be at least substantially parallel to the first path and each path can be horizontal or nearly horizontal), and advancing the diverted first panels along the second path at a lower second speed while continuing to transport the second panels which immediately follow the diverted first panels at the first speed to ensure that at least one of each pair of panels including a diverted first panel and the immediately following second panel develops a loop and the second panel of the pair of panels overlies the respective first panel.

The diverting step can include establishing a pressure differential between opposite sides of each first panel so that the first panels are moved sideways and enter the second path, and the advancing step then includes attracting the diverted first panels to at least one driven conveyor, at least during the initial stage of the formation of a loop in the at least one panel of the respective pair of first and second panels.

The advancing step can include gradually decelerating the first panels from the first to the second speed or stepwise decelerating the first panels from the first to the second speed. The second speed can embrace a range of speeds, preferably a series of speeds wherein each preceding speed exceeds the next-following speed.

The transporting step can include pushing the second panels in the predetermined direction in the course of the diverting step, and such pushing step can include attracting the second panels by suction to at least one driven conveyor, e.g., to a foraminous overhead belt conveyor.

The method preferably further comprises the step of stabilizing the loops, including admitting one or more jets of air or another suitable gaseous fluid into the loops.

The advancing step preferably includes moving the diverted first panels at a speed less than the speed of the immediately following second panels until the second panels at least nearly completely overlie the immediately preceding first panels. Such method preferably further comprises the step of accumulating the overlapped first and the overlapping second panels into a stack. An additional step of the method can include severing the weakened zones between selected first and immediately following second panels in the stack.

Another feature of the invention resides in the provision of an apparatus for zig-zag folding a continuous web of paper or a like flexible material which has alternating first and second panels connected to each other by transversely extending weakened zones in the form of rows of perforations or the like. The apparatus comprises a transporting unit which serves to move the web lengthwise along a first path in a predetermined direction and at a first speed, and means for diverting portions at least of successive first panels from the first path into a second path and for advancing the diverted first panels along the second path at a lower second speed so that at least one of each pair of panels including the diverted first panel and the immediately following second panel develops a loop as the second panel of such pair of panels continues to move at the first speed. The second path can be offset with reference to the first path substantially at right angles to the predetermined direction, and the diverting means can include means for defining a step between the first and second paths, i.e., between the transporting means and the advancing means of the diverting means.

The diverting means can comprise a foraminous conveyor and a suction chamber adjacent one side of the foraminous conveyor to attract successive first panels to the other side of the foraminous conveyor.

In addition to or in lieu of the just mentioned foraminous conveyor, the diverting means can comprise at least one panel-decelerating conveyor means arranged to (directly or indirectly) receive first panels from the transporting means and to advance the first panels at the second speed. For example, the diverting means can comprise a battery or series of two or more panel-decelerating conveyor means wherein each preceding conveyor means is faster than the immediately following conveyor means. Such apparatus can further comprise overhead conveyor means overlying the diverting means and having means for attracting the loops and for pushing the thus attracted loops in the predetermined direction. The panel-decelerating and/or the overhead conveyor means can be foraminous, and the apparatus then further comprises suction chambers cooperating with the foraminous conveyor means to attract first panels to the decelerating conveyor means and to attract the loops to the overhead conveyor means.

The apparatus preferably further comprises means for stacking the first and second panels on top of each other downstream of the diverting means, and means for severing selected weakened zones of the web in the stacking means so that each of the thus obtained discrete stacks contains a desired number of overlapping first and second panels.

The apparatus preferably further comprises means for stabilizing the loops, and such stabilizing means can comprise one or more nozzles or other suitable means for admitting air or another gaseous fluid into the loops.

The second path is or can be substantially or exactly parallel to the first path, and the diverting means preferably (but not necessarily) includes means for looping the second panels of successive pairs of immediately adjacent first and second panels.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The FIGURE is a schematic partly elevational and partly vertical sectional view of a folding apparatus which embodies one form of the invention and whose diverting unit comprises a series of five interlinked decelerating conveyors.

DESCRIPTION OF THE PREFERRED EMBODIMENTS

The combined folding and stacking apparatus which is shown in the drawing comprises a web transporting unit 1, a diverting unit 2 and a stacking unit 3. The transporting unit 1 serves to advance a continuous web 9 of coherent panels or sheets 41 lengthwise in the direction of arrow 4*a* and at a first speed preferably matching the speed of the web as it issues from a perforating station where the zones or regions 39 between neighboring panels 41 are weakened by rows of transversely extending perforations, slits or the like. The means for defining a substantially horizontal (first) path for the web 9 comprises an endless belt conveyor 7 which is trained over several pulleys 8 (only one shown in the drawing) and is driven at the first speed by an electric motor M1 or another suitable prime mover which transmits torque to the shaft 8*a* for the illustrated pulley 8. The transporting unit 1 preferably further comprises an endless foraminous overhead belt conveyor 4 which is trained over several pulleys 6 (only one shown). The shaft 6*a* for the illustrated pulley 6 is driven by the motor M1 at the speed of the belt conveyor 7. The web 9 is caused to advance in the channel between the substantially horizontal upper reach of the conveyor 7 and the adjacent lower reach of the conveyor 4.

The panels 41 of the web 9 are preferably congruent so that each next-following (second) panel (41*b*) of a pair of neighboring panels 41 can accurately overlie the immediately preceding (first) panel 41*a* of such pair of panels. Thus, it can be said that the web 9 consists of a series of successive pairs of first and second panels 41*a*, 41*b* and that weakened zones 39 are provided between the panels (41*a*, 41*b*) of each pair of panels as well as between the second panel 41*b* of a preceding pair and the first panel 41*a* of the next-following pair. It is clear that the web 9 can consist of or that it can contain a flexible material other than paper, e.g., metallic or plastic foil or lightweight cardboard.

Each of the belt conveyors 4, 7 (as well as each other belt conveyor used in the apparatus of the present invention) can comprise, and often comprises, two or more endless belts which are disposed in parallel vertical planes and are trained over sets of coaxial pulleys in a manner well known from the art of transporting webs, panels and sheets of paper or the like. For example, the conveyor 4 can comprise two, three or more discrete endless belts which are trained over discrete pulleys 8 on the shaft 8*a* or over a single pulley which is driven by the shaft 8*a*, as well as over discrete idler pulleys (not shown) or a common idler pulley on at least one additional shaft of the transporting unit 1.

The diverting unit 2 comprises a transversely extending ledge 13 whose upper side is flush with the upper side of the upper reach of the conveyor 7 and which defines a step at a location 12 where successive first panels 41*a* are diverted from the path which is defined by the conveyors 4 and 7. The diversion takes place in a direction at right angles to that which is indicated by the arrow 4*a* and such diversion is effected by a suction chamber 14 in conjunction with the upper end 11*a* of an endless foraminous first belt conveyor 11 of the diverting unit 2. The conveyor 11 constitutes the first component of the means for advancing successive first panels 41*a* along a second horizontal path which is parallel to the path between the conveyors 4, 7 of the transporting unit 1 and wherein the panels 41*a* advance at a second speed less than the speed of the conveyors 4 and 7. The ledge 13 overlies a portion of the upper reach 11*a* and its height determines the extent to which the panels 41*a* are diverted or deflected from the path between the conveyors 4 and 7 of the transporting unit 1. The upper side of the suction chamber 14 has an opening (actually a composite opening composed of apertures in the form of slots, holes and/or analogous passages for air) which is adjacent to the underside of the upper reach 11*a* of the conveyor 11 and can be sealed or exposed by a plate-like valving element 17 at the upper end of a motion transmitting rod 19 which is reciprocable in a bore of a stationary guide member 18 and carries a roller follower 21 tracking a rotary cam 22 deriving motion from the motor M1, e.g., through the medium of the shaft 8*a* for the front pulley 6 of the belt conveyor 7. The purpose of the suction chamber 14 is to intermittently establish a pressure differential between opposite sides of the web 9 (namely between opposite sides of successive panels 41*a*) by way of the upper reach 11*a* of the foraminous conveyor 11 and to thus divert successive panels 41*a* from the path which is defined by the conveyors 4, 7 of the transporting unit 1. The torque transmitting connection between the shaft 8*a* and the cam 22 is such that the movements of the valving element 17 to and from its sealing position are synchronized with the advancement of successive panels 41*a* along the path which is defined by the conveyors 4 and 7.

The reciprocable valving element 17 can be replaced with a pivotable valving element without departing from the spirit of the invention. When the valving element 17 descends to permit atmospheric air to flow into the suction chamber 14 through the perforations or pores of the upper reach 11*a*, the upper side of the upper reach 11*a* attracts the oncoming panel 41*a* and causes the immediately following panel 41*b* to develop a loop 42 which grows as the just discussed panels 41*a*, 41*b* advance along the suction chamber 14 because the speed of the upper reach 11*a* is less than the speed of the conveyors 4 and 7. The means for driving the conveyor 11 at a speed which is less than the speed of the conveyors 4 and 7 includes a second electric motor M2 or an analogous prime mover which transmits torque to the shaft for the lower pulley 23 of the conveyor 11. The two upper pulleys 23*a*, 23*b* are disposed at the left-hand and right-hand ends of the upper reach 11*a* and define for successive panels 41*a* a horizontal path which is parallel to and disposed at a level below the path between the conveyors 4 and 7. The pulleys 23*a* and 23*b* need not be driven.

The diverting unit 2 further comprises a series 24 of interlinked panel-decelerating conveyors 24*a* and 24*e* which are driven at a progressively lower speed, i.e., the speed of the conveyor 24*a* exceeds the speed of the conveyor 24*b*, and so forth. This ensures a gradual deceleration of successive panels 41*a* during travel toward the stacking station 3. Each conveyor of the series 24 of conveyors comprises one, two or more endless foraminous belt conveyors whose upper reaches are in line with the upper reach 11*a* and are disposed above discrete suction chambers 28 so that the upper reaches of the conveyors 24*a* to 24*e* can attract the panels 41*a* during advancement of such panels toward the stacking station 3. The prime movers for the conveyors 24*a* to 24are respectively shown at M3, M4, M5, M6 and M7. These prime movers can constitute variable-speed electric motors, the same as the prime movers M1 and M2, and they can drive the respective panel-decelerating conveyors at desired speeds to effect an appropriate deceleration of the panels 41*a* during travel of such panels from the upper reach 11*a* toward an accumulating magazine 36 at the station for the unit 3. Such series of conveyors are well known in the paper processing industry, therefore the motion transmitting connections between the motors M3–M7 on the one hand and the belts of the conveyors 24*a* to 24*e* on the other hand are not shown in full detail. In the drawing, the visible pulleys 26 are fixedly mounted on the shafts which are driven by the motors M4 and M6, respectively. The visible pulleys 27 are idler pulleys which are rotatably mounted on their respective shafts. The motor M3 drives the shaft for the idler pulley or pulleys 23*b*; such shaft carries the driven pulley or pulleys for the conveyor 24*a*. These driven pulleys, not shown, are mounted behind the pulley 23*b*. The idler pulley or pulleys (not shown) for the conveyor 24*a* are mounted on the shaft for the driven pulleys 26 of the conveyor 24*b*. The driven pulley or pulleys of the conveyor 24*b* are driven by the motor M4, and the conveyor 24*b* is further trained over one or more idler pulleys 27 one of which is visible on the shaft for the driven pulley or pulleys, not shown, of the conveyor or conveyors 24*c*. These driven pulleys of the conveyor 24*c* are driven by the motor M5, and the conveyor or conveyors 24*c* are further trained over one or more idler pulleys (not shown) on the shaft (driven by the motor M6) for the driven pulley or pulleys 26 (one of which can be seen) of the conveyor or conveyors 24*d*. The idler pulley or pulleys 27 for the conveyor or conveyors 24*d* (one of these pulleys is shown) are mounted on the shaft for the non-illustrated pulley or pulleys (driven by the motor M7) for the conveyor or conveyors 24*e* . The idler pulley or pulleys for the conveyor or conveyors 24*e* are shown at 27 adjacent the magazine 37 for the stack 43 of fully overlapping panels 41*a* and 41*b*.

The suction chambers 28 below the upper reaches of the conveyors 24*a*–24*e* are connected to an intake of the suction generating device 16 which also serves to evacuate air from the suction chamber 14 (or to a discrete second suction generating device).

A portion of the lower reach of the overhead conveyor 4 is adjacent to a further suction chamber 29 which is connected to the suction generating device 16 or to a discrete suction generating device and is located at a level above the idler pulley or pulleys 23*b*. The purpose of the suction chamber 29 is to enable the lower reach of the conveyor 4 to attract the developing loops 42 and to push such loops in a direction toward the stacking station 3. The lower reach of the conveyor 4 is in line with the lower reach of a second overhead conveyor 31 which is or can be foraminous and is driven by the motor M2 or by a discrete motor. The shaft 6*a* for the pulley or pulleys 6 of the conveyor 4 carries the idler pulley or pulleys for the conveyor 31. The motor M2 drives the right-hand pulley or pulleys 32 of the conveyor 31. The transmission between the motor M2 and the pulley or pulleys 32 is or can be such that the speed of the overhead conveyor 31 exceeds the speed of the conveyors 24*a*–24*e* but is less than the speed of the conveyors 4 and 7 of the transporting unit 1. In the illustrated apparatus the conveyor 31 is driven at or close to the speed of the conveyor 11, i.e., at a speed less than that of the conveyor 4 but higher than that of the fastest panel-decelerating conveyor (24*a*) of the series 24.

The apparatus preferably further comprises a loop stabilizing device including one or more nozzles 33 which are connected to the outlet of a source 34 of compressed air or another suitable gaseous fluid and serve to admit jets of compressed gaseous fluid into the loops 42 during advancement of the loops at a level below the overhead conveyor 31 of the diverting unit 2. For example, the loop stabilizing device can comprise two nozzles 33, one at each side of the path which is defined by the conveyors 11, 24*a*–24*e* of the diverting path 2, to admit streams of compressed air into the respective open sides of the adjacent loops 42 and to thus ensure that the loops do not collapse while the panels 41*b* are in the process of catching up with the immediately preceding panels 41*a* on their way from the ledge 13 toward the magazine 36.

The magazine 36 accumulates a stack 43 of accurately overlapping panels 41*a*, 41*b*, and the apparatus further comprises a severing device 37 having a reciprocable and transversely movable sword 38 or another suitable severing tool which penetrates into the stack 43 at predetermined intervals to sever a selected weakened zone 39 and to thus enable the magazine 36 to accumulate a series of stacks 43 each of which contains a predetermined number of overlapping panels. The manner in which the panels of the stack 43 are counted and the manner in which the counter transmits signals to the means for moving the sword 38 into and transversely of the magazine 36 form no part of the present invention.

The mode of operation is as follows:

The conveyors 4 and 7 of the transporting unit 1 move the web 9 in the direction of the arrow 4*a* whereby successive panels 41*a* advance toward and over the ledge 13 and are attracted to the upper reach 11*a* of the conveyor 11 in the diverting unit 2 in response to cyclical lowering of the valving element 17 as a result of rotation of the cam 22 under the action of the shaft 8*a*. The arrangement is preferably such that the valving element 17 is lowered as soon as the leader of a panel 41*a* advances to the location 12 immediately downstream of the ledge 13. This entails a deceleration of the panels 41*a* because the speed of the upper reach 11*a* is less than the speed of the conveyors 4 and 7. However, the immediately following panels 41*b* continue to advance at the speed of the conveyors 4, 7 because the lower reach of the conveyor 4 overlies the upper reach 11*a* of the conveyor 11 so that the panels 41*b* and/or the adjacent rear portions of the immediately preceding panels 41*a* develop the respective loops 42 which are attracted to the lower reach of the conveyor 4 during travel along the underside of the suction chamber 29 so that these loops are actually pushed in the direction of the arrow 4*a* at a speed higher than the speed of the panels 41*a* adhering to the upper reach 11*a* of the conveyor 11. The making of loops 42 is desirable and advantageous because they prevent creasing of the web 9 and the formation of an irregular stack of panels in the magazine 36. The suction chamber 29 enables the lower reach of the overhead conveyor 4 to attract the developing loops 42 and to push the loops, and the corresponding panels 41*b*, in the direction of the arrow 4*a* at a speed which matches the speed of the conveyor 7 and thus exceeds the speed of the conveyor 11 which latter advances the panels 41*a*. The feature that the loops 42 are attracted to the lower reach of the conveyor 4 by suction contributes to stability of the loops and further reduces the likelihood of unpredictable folding of the web 9 while its panels advance toward the stacking station 3.

The underside of the lower reach of the overhead conveyor 13 contributes to a continuous increase in the dimensions of the loops 42 which advance at a level above the series 24 of conveyors 24*a* to 24*e*. As explained above, the conveyor 32 is driven at the speed of the conveyor 11, i.e., its speed is greater than that of the fastest panel-decelerating conveyor 24*a*. Consequently, the panels 41*b* continue to catch up with the immediately preceding panels 41*a* while such panels advance in the channel between the lower reach of the conveyor 31 on the one hand and the upper reaches of the conveyors 24*a* to 24*e* on the other hand. The nozzle or nozzles 33 contribute to desirable stabilization of the loops 42 by admitting a compressed gaseous fluid medium into one or both open sides of each loop in the region above the conveyor 24*a*. The apparatus can be provided with two or more sets of nozzles, e.g., with a first set above the conveyor 24*a*, with a second set above the conveyor 24*b*, and so forth. The cushions of air which develop in the loops 42 stabilize the loops and contribute to predictability of conversion of the web 9 into a stack 43 which is automatically deposited in the magazine 36 and can be expelled, for example, in a direction toward or away from the observer of the drawing. The conveyor 31 cooperates with the loops 42 therebelow to push the corresponding panels 41*b* toward the stacking station 3 at a speed which exceeds the speed of the conveyors 24*a* to 24*e* so that the panels 41*b* at least nearly completely overlie the immeidately preceding panels 41*a* not later than at the left-hand side of the magazine 36 but certainly at the time when the panels 41*a*, 41*b* are permitted to descend onto the bottom wall of the magazine 36 or onto the panels which are already confined in the magazine.

The conveyor 31 is or can be foraminous, and the apparatus can further comprise one or more suction chambers (not shown) at a level above the lower reach of the conveyor 31 to attract the loops 42 and to even more reliably ensure predictable gradual or stepwise overlapping of each panel 41*a* by the immediately following panel 41*b* during travel of such panels from the ledge 13 toward the open upper side of the magazine 36. The need for one or more suction chambers above the lower reach of the conveyor 31 will depend on a variety of parameters, such as the stiffness or lack of stiffness of the web 9, the degree of accuracy with which the panels 41*a* and 41*b* are to be stacked on top of each other, and others.

It is further within the purview of the invention to replace the single overhead conveyor 31 with a series of two, three or more discrete conveyors similar to the conveyors 24*a* to 24*e*. The conveyors of the series of conveyors which are to replace the conveyor 31 must be driven in such a way that each conveyor of the series advances a loop 42 faster than the conveyor (24*a*, 24*b*, 24*c*, 24*d* or 24*e*) therebelow. This ensures predictable advancement of the panels 41*b* at a speed which exceeds the speed of the immediately preceding panels 41*a*.

The loops 42 can be formed by the trailing portions of the panels 41*a* and/or by the leaders of the panels 41*b*. The valving element 17 and the means for moving this valving element in synchronism with the travel of panels 41*a* along the path which is defined by the transporting unit 1 ensure that each pair of neighboring panels 41*a*, 41*b* develops a loop 42 whose configuration and growth are identical with those of each previously formed loop. The number of conveyors in the series 24 can be increased to such an extent that the panels 41*a* undergo a practically gradual (rather than a more or less pronounced stepwise) deceleration during travel from the conveyor 11 to the magazine 36. The conveyors 24*a* to 24*e* of the series 24 ensure predicatable guidance of the panels 41*a* all the way from the conveyor 11 to the stacking station 3 and, together with predictable guidance and transport of the panels 41*b*, ensure the formation of a stack 43 wherein each panel 41*b* accurately overlies the panel 41*a* therebelow. The suction chamber 29 and the stabilizing nozzles 33 constitute optional but highly desirable and advantageous features of the improved apparatus. The making of a stack 43 wherein the panels 41*a* and 41*b* accurately overlap each other is desirable and advantageous because such stacks can be readily manipulated, e.g., piled on top of additional stacks, wrapped, compacted, etc. The severing device 37 ensures that a continuous stack 43 can be subdivided into smaller stacks each of which contains a preselected number of panels 41*a* and 41*b*.

An important advantage of the improved apparatus are its simplicity and compactness. Thus, all that is necessary is to provide a unit which can divert alternate panels (41*a*) from the path of the web 9 and can predictably decelerate the diverted panels while continuing to advance the non-diverted panels (41*b*) at the speed of the web 9 or at a speed which can be less than the speed of the web but exceeds the speed of the immediately preceding diverted panels 41*a*. The various suction chambers and conveyors with means for driving them at selected speeds are components which add little to the complexity of the apparatus but enable the apparatus to zig-zag fold the web 9 with a very high degree of predictability and in a small area. Reliable catching up of the panels 41*b* with the immediately preceding panels 41*a* is ensured by the conveyors 24*a* to 24*e* and by the overhead conveyor 31. The provision of suction chambers 28, 29 and, if necessary, one or more suction chambers above the lower reach of the conveyor 31, reduces the likelihood of creasing of the web 9 at locations other than the weakened zones 39.

The utilization of conveyors which define substantially horizontal paths for the web 9, for the panels 41*a* and for the loops 42 contributes to simplicity of the apparatus and ensures that all or nearly all parts of the apparatus are readily accessible.

The improved apparatus can fold a web 9 at a high speed without employing reciprocating, oscillating and/or otherwise moving grippers or analogous parts which are necessary in conventional zig-zag folding apparatus. The utilization of conveyors which define substantially horizontal paths renders it possible to build an apparatus whose height is much less than the height of an apparatus wherein the web is fed vertically downwardly. This simplifies the task of the attendants and contributes to a higher output because the number of down times can be reduced by facilitating convenient access to all parts of the apparatus or, at the very least, to all such parts which are more likely to be contaminated and/or otherwise affected by extensive use. The severing device 37 also contributes to versatility of the apparatus and to convenience of forming stacks containing predetermined numbers of panels.

It is also within the purview of the invention to replace the series of conveyors 24*a* to 24*e* with a single conveyor or with a member having a smooth surface or with a plurality of parallel guide rails. This arrangement is especially suitable for folding webs the properties of which ensure the continuation of the catch-up process started by diverting successive panels 41*a* in the diverting unit 2 only by the motion imparted to the web by the conveyors 4 and 7 and possibly 31.

One embodiment of a suitable severing device 37 is described in U.S. Pat. No. 3,784,188.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of zig-zag folding a continuous web of paper or a like flexible material which has alternating first and second panels connected to each other by transversely extending weakened zones, comprising the steps of transporting the web at a first speed in a predetermined direction and along a first path; diverting at least a portion of each of successive first panels from the first path into a second path; and advancing the diverted first panels at a lower second speed while continuing to transport the second panels immediately following the diverted first panels at said first speed so that at least one of each pair of panels including a diverted first panel and the immediately following second panel develops a loop and the second panel of such pair of panels overlies the respective first panel.

2. The method of claim 1, wherein said diverting step includes establishing a pressure differential between opposite sides of each first panel so that the first panels are moved sideways and enter said second path, said advancing step including attracting the diverted first panels to at least one driven conveyor, at least during the initial stage of the formation of a loop in said at least one panel of the respective pair of panels.

3. The method of claim 1, wherein said advancing step includes gradually decelerating the first panels from said second speed to at least one further lower speed.

4. The method of claim 1, wherein said advancing step includes stepwise decelerating the first panels from said second speed to at least one further lower speed.

5. The method of claim 1, wherein said transporting step includes pushing the second panels in said direction in the course of said diverting step.

6. The method of claim 5, wherein said pushing step includes attracting the second panels by suction to a driven conveyor.

7. The method of claim 1, further comprising the step of stabilizing the loops including admitting a gaseous fluid into the loops.

8. The method of claim 1, wherein said advancing step includes moving the diverted first panels at a speed less than the speed of the immediately following second panels until the second panels at least nearly completely overlie the immediately preceding first panels, and further comprising the step of accumulating the overlapped first and the overlapping second panels into a stack.

9. The method of claim 8, further comprising the step of severing the weakened zones between selected first and immediately following second panels in the stack.

10. Apparatus for zig-zag folding a continuous web of paper or a like flexible material which has alternating first and second panels connected to each other by transversely extending weakened zones, comprising a transporting unit arranged to move the web lengthwise along a first path in a predetermined direction and at first speed; and means for diverting portions at least of successive first panels from said first path into a second path and for advancing the diverted first panels along said second path at a lower second speed so that at least one of each pair of panels including the diverted first panel and the immediately following second panel develops a loop as the second panel of the pair of panels continues to move at said first speed.

11. The apparatus of claim 10, wherein said second path is offset with reference to said first path substantially at right angles to said direction and said diverting means includes means defining a step between said first and second paths.

12. The apparatus of claim 10, wherein said diverting means comprises a foraminous conveyor and a suction chamber adjacent one side of said conveyor and arranged to attract successive first panels to the other side of said conveyor.

13. The apparatus of claim 12, wherein said advancing means comprises at least one panel-decelerating conveyor means arranged to receive first panels from said transporting means and to advance the first panels at said second speed.

14. The apparatus of claim 13, further comprising overhead conveyor means overlying said diverting means and having means for attracting and pushing the loops in said direction.

15. The apparatus of claim 14, wherein said conveyor means are foraminous and further comprising suction chambers cooperating with said conveyor means to attract the first panels to said decelerating conveyor means and to attract the loops to said overhead conveyor means.

16. The apparatus of claim 10, further comprising means for stacking the first and second panels downstream of said diverting means.

17. The apparatus of claim 16, further comprising means for severing selected weakened zones of the web in said stacking means.

18. The apparatus of claim 10, wherein at least one of said paths is at least substantially horizontal.

19. The apparatus of claim 10, further comprising means for stabilizing the loops including means for admitting a gaseous fluid into the loops.

20. The apparatus of claim 10, wherein said second path is substantially parallel to said first path and said diverting means includes means for looping the second panels of successive pairs of first and second panels.

* * * * *

UNITED STATES PATENT AND TRADEMARK OFFICE

CERTIFICATE OF CORRECTION

PATENT NO. : 4,708,332

DATED : November 24, 1987

INVENTOR(S) : Alfred BESEMANN

It is certified that error appears in the above-identified patent and that said Letters Patent are hereby corrected as shown below:

Foremost Page - [30] Foreign Application Priority Data: "3424246" should read --3524246--.

Col. 8, Line 7 - "13" should read "31".

Signed and Sealed this

Eighteenth Day of October, 1988

*Attest:*

DONALD J. QUIGG

*Attesting Officer*

*Commissioner of Patents and Trademarks*